US006934401B2

(12) United States Patent
Grell et al.

(10) Patent No.: US 6,934,401 B2
(45) Date of Patent: Aug. 23, 2005

(54) CLOSED HEADPHONES WITH TRANSDUCER SYSTEM

(75) Inventors: Axel Grell, Burgdorf (DE); Kornelia Kaddig, Wietze (DE)

(73) Assignee: Sennheiser electronics GmbH & Co. KG, Wedemark (DE)

( * ) Notice: Subject to any disclaimer, the term of this patent is extended or adjusted under 35 U.S.C. 154(b) by 0 days.

(21) Appl. No.: 10/226,705

(22) Filed: Aug. 22, 2002

(65) Prior Publication Data

US 2003/0039375 A1 Feb. 27, 2003

(30) Foreign Application Priority Data

Aug. 24, 2001 (DE) ..... 101 40 663

(51) Int. Cl.[7] ..... H04R 25/00
(52) U.S. Cl. ..... 381/371
(58) Field of Search ..... 381/370, 371, 381/372, 373, 376, 430, 71.6, 72, 71.7, 367

(56) References Cited

U.S. PATENT DOCUMENTS 4,239,945 A * 12/1980 Atoji et al. ..... 381/371
4,965,836 A * 10/1990 Andre et al. ..... 381/370
5,729,605 A * 3/1998 Bobisuthi et al. ..... 379/430
5,844,998 A * 12/1998 Nageno ..... 381/371
6,597,792 B1 * 7/2003 Sapiejewski et al. ..... 381/71.6

FOREIGN PATENT DOCUMENTS

DE 11 35 045 8/1962
DE 197 37 461 3/1999

* cited by examiner

*Primary Examiner*—Curtis Kuntz
*Assistant Examiner*—Brian Ensey
(74) *Attorney, Agent, or Firm*—Reed Smith LLP

(57) ABSTRACT

Headphones of various designs and types of construction, in particular also closed headphones, have been known for a long time. Headphones of the type mentioned above should have the desired frequency response in all frequency positions and, in particular, this frequency response should be as linear and uniform as possible in the lower frequency range in order to allow good transmission in low frequencies as well. It is the object of the invention to simplify the damping of the fundamental resonance of transducer systems, to improve quality and to save costs. Closed headphones with an acoustic transducer with a diaphragm system which separates a front volume from a rear volume, the rear volume being so small that it does not act as a spring in the range of the fundamental resonance of the transducer system.

5 Claims, 2 Drawing Sheets

CLOSED HEADPHONES WITH TRANSDUCER SYSTEM

CROSS-REFERENCE TO RELATED APPLICATIONS

This application claims priority of German Application No. 101 40 663.0, filed Aug. 24, 2001, the complete disclosure of which is hereby incorporated by reference.

BACKGROUND OF THE INVENTION a) Field of the Invention

The present invention is directed to the manufacture and use of headphones, in particular, closed head phones.

b) Description of the Related Art

Headphones of various designs and types of construction, in particular also closed headphones, have been known for a long time.

Headphones of the type mentioned above should have the desired frequency response in all frequency positions and, in particular, this frequency response should be as linear and uniform as possible in the lower frequency range in order to allow good transmission in low frequencies as well.

For damping fundamental resonance, it is known from DE 11 35 045 to adjust a flow resistance in the acoustic baffle between the rear volume and front volume, so that the desired frequency response is achieved. This reference also discloses that outlets are provided at the rear volume which open into free space, while other outlets are provided which extend from the rear volume into the front volume via the acoustic baffle.

However, as can be gathered from the above-cited reference, each of the passages between the rear volume and front volume is provided with an acoustic flow resistance which is designed in such a way that the transducer system adopts the desired natural resonance or damping of this resonance.

In known transducer systems, the natural resonance of the electrodynamic transducer is damped by a body functioning as a flow resistance. Often, this body is coupled to the oscillating diaphragm and provides for a very small air volume between the oscillating diaphragm and the suspension or surround of the diaphragm (in a dynamic transducer with outer surround). Known bodies for forming the flow resistance comprise a partially permeable material which is rather flat in proportion to its extension in the plane. An example of a construction of a body of this kind which forms a flow resistance is also described in German Patent Application DE 197 37 461. In this case, the damping means comprise a sintered material and accordingly form a three-dimensional structure.

The volume between the diaphragm and the damping means usually has a diameter no larger than the moving diaphragm, and the height of the volume between the diaphragm and damping means is usually in the range of about 0.1 mm to 5 mm, preferably 0.2 mm to 4 mm. Closed headphones have a volume in front of the diaphragm—the front volume—which is defined by the ear, the ear cushion of the headphones and the acoustic baffle. Further, headphones of this type have a rear volume which is divided from the front volume by the diaphragm and the acoustic baffle and which, for the rest, is defined by the headphone ear shell and the acoustic baffle.

Finally, the rear volume also has the openings, already described above, according to Pat. DE 11 35 045.

In order to adjust the low-frequency component of the sound to be reproduced correctly in relation to the high-frequency component, a flow resistance is built into the acoustic baffle. As this resistance decreases, the reproduction of lower frequencies becomes softer or fainter in relation to high frequencies.

OBJECT AND SUMMARY OF THE INVENTION

It is the primary object of the invention to simplify the damping of the fundamental resonance of transducer systems, to improve quality and to save costs.

According to the invention, this object is met by a transducer system having closed headphones comprising an acoustic transducer with a diaphragm arrangement which separates a front volume from a rear volume, the rear volume being so small that it does not act as a spring in the range of a fundamental resonance of the transducer.

In contrast to the prior art, the natural resonance of the transducer system is not damped by damping means, but solely through the rear volume and flow resistance. The rear volume is so small that it does not act as a spring (that is, functions as a kind of rod) in the range of the fundamental resonance of the transducer system.

The advantages according to the invention are, first, that it saves costs because damping means are no longer necessary and because any damping means also represent a component part that is subject to tolerances; manufacturing quality can also be improved as a whole because an additional component part that is subject to tolerances, such as damping means, need no longer be employed.

The invention is extremely effective in damping fundamental resonance, as can also be seen by the indicated measurements.

DESCRIPTION OF THE PREFERRED EMBODIMENTS

Figure 1:
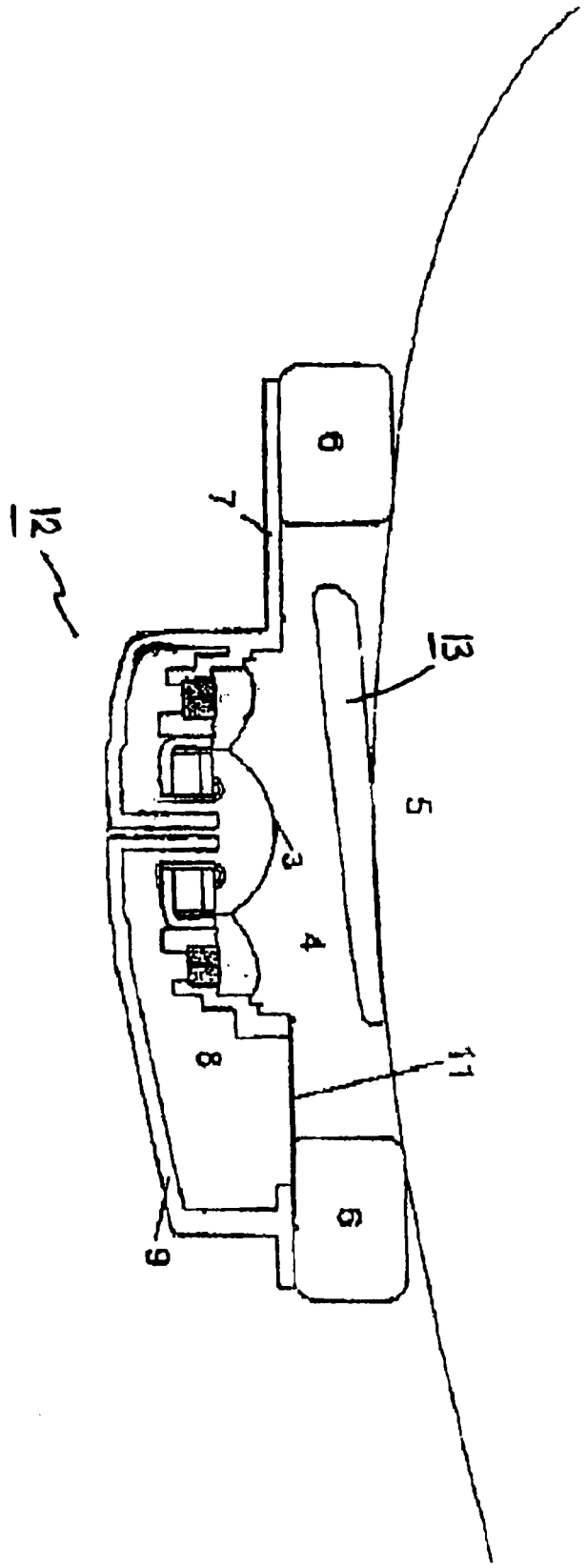
FIG. 1 shows a cross-section of a closed headphone according to the invention.

FIG. 1 shows closed headphones 12 having ear cushions 6 which surround the ear of the wearer and rest against the head 5 of the user. Accordingly, a front volume 4 is defined in the area between the head 5, ear 13, ear cushion 6, acoustic baffle 7 and transducer diaphragm 3.

In the embodiment form shown in the drawing, the transducer system is a dynamic transducer system with a coil which penetrates into the air gap and is deflected in the latter when driven by a signal. In the rear area, the headphones have an ear shell 9 whose interior, together with the acoustic baffle 7 and diaphragm system 3, defines a rear volume 8.

Further, a flow resistance 11 is provided between the front volume and the rear volume so that air (when there is overpressure relative to the front volume) can flow out of the rear volume into the front volume—with corresponding pressure equalization.

The special part played by the flow resistance also consists in that dV ($\Delta V$) in the rear volume caused by an excursion of the diaphragm leads to such a dV with inverted sign in the front volume. This causes the volume flow described above through the flow resistance which then blocks diaphragm movement.

For this purpose, the flexibility or resilience of the diaphragm should be correspondingly great in relation to the rear volume, for example, greater than a ratio of 10:1, preferably 25:1, although values in the range of 100:1 or more are still acceptable.

Figure 2:
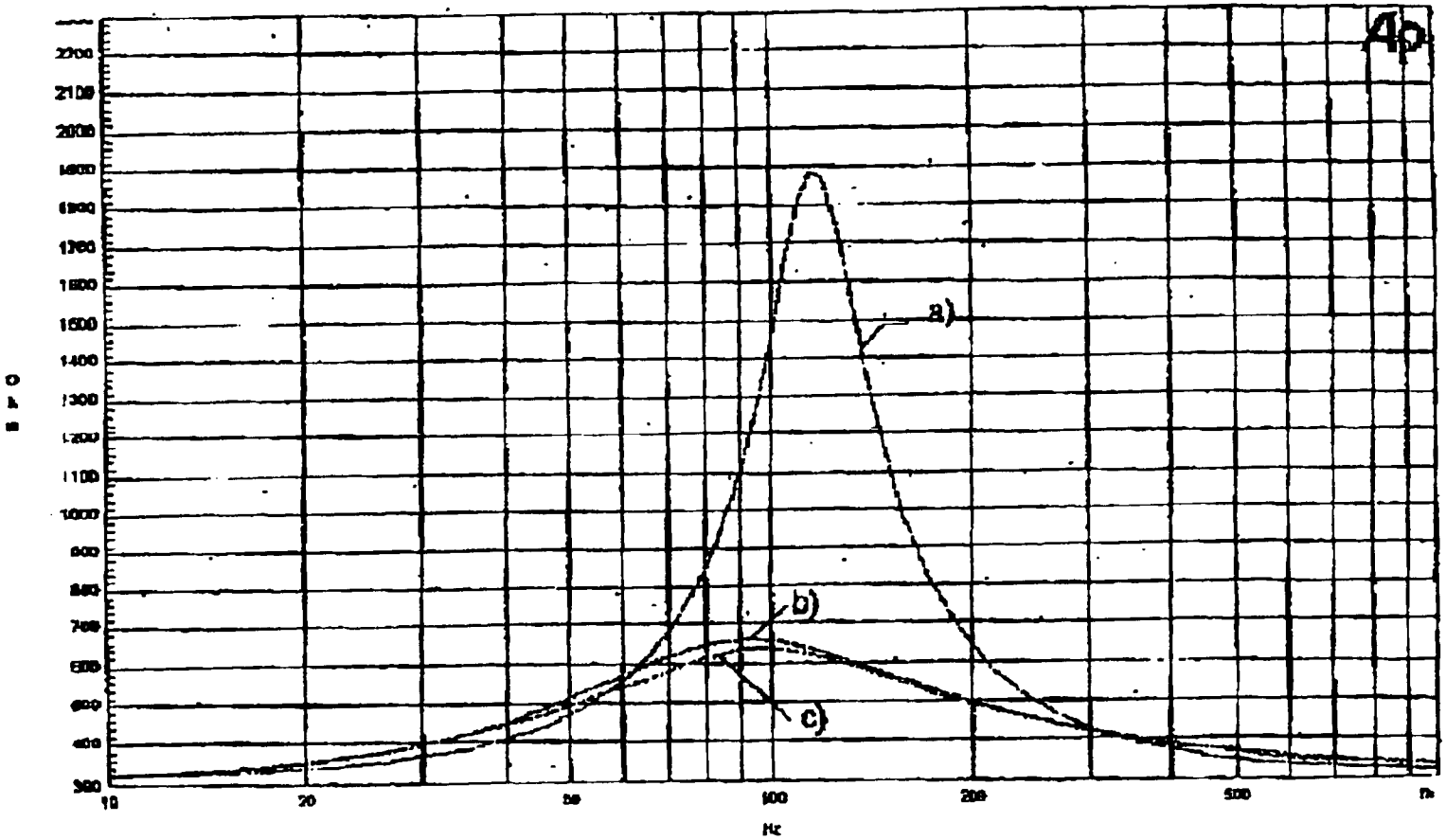
FIG. 2 is a graph showing three impedence curves of the headset.

The behavior of the transducer according to the invention is shown by the impedance curve in FIG. 2, wherein a) shows an impedance curve of the transducer without damping (free air), b) shows an impedance curve of the transducer with damping according to the invention (front open), and c) shows the impedance curve of the transducer with damping according to the invention (transducer works on front volume).

As can be seen, the fundamental resonance of the transducer system is damped extremely effectively without the need for the damping means previously used. Since damping means of this type are components that are naturally subject to tolerances, not only can production be made more economical overall, but the quality of the entire transducer system, and therefore of the closed headphones, is also improved.

While the foregoing description and drawings represent the present invention, it will be obvious to those skilled in the art that various changes may be made therein without departing from the true spirit and scope of the present invention.

What is claimed is:

1. Closed headphones comprising:

an acoustic transducer with a diaphragm arrangement which separates a front volume from a rear volume;

said rear volume being so small that it does not act as a spring in the range of a fundamental resonance of the transducer, wherein a flow resistance is formed between the rear volume and the front volume, wherein air can flow through this flow resistance from the rear volume into the front volume when there is overpressure.

2. Headphones according to claim 1, wherein the ratio of the flexibility of the diaphragm to the rear volume is greater than 10:1.

3. Headphones according to claim 2, wherein the ratio of the flexibility of the diaphragm to the rear volume greater than 10:1 and less than or equal to about 100:1.

4. Closed headphones comprising:

a transducer system which separates a front volume from a rear volume, and a flow resistance is formed between the rear volume and the front volume, and air can flow through this flow resistance from the rear volume into the front volume when there is overpressure;

wherein in order to damp the fundamental resonance of the transducer system, the rear volume is so small that it does not act as a spring in the range of a fundamental resonance.

5. Headphones according to claim 3, wherein the ratio of the flexibility of the diaphragm to the rear volume is about 25:1.

* * * * *